US005194778A

United States Patent [19]

Koh

[11] Patent Number: 5,194,778

[45] Date of Patent: Mar. 16, 1993

[54] ELECTRON GUN FOR COLOR CATHODE RAY TUBE

[75] Inventor: Nam J. Koh, Gumi, Rep. of Korea

[73] Assignee: Goldstar Co., Ltd., Rep. of Korea

[21] Appl. No.: 557,393

[22] Filed: Jul. 23, 1990

[30] Foreign Application Priority Data

Jul. 31, 1989 [KR] Rep. of Korea ..... 10919/1989

[51] Int. Cl.[5] ..... H01J 29/46; H01J 29/56

[52] U.S. Cl. ..... 315/15; 313/414; 313/449

[58] Field of Search ..... 315/14, 15, 382; 313/414, 449

[56] References Cited

U.S. PATENT DOCUMENTS 4,701,677 10/1987 Ashizaki et al. ..... 315/382

4,866,335 9/1989 Cho ..... 313/414

*Primary Examiner*—Theodore M. Blum

*Attorney, Agent, or Firm*—Anthony J. Casella; Gerald E. Hespos

[57] ABSTRACT

An electron gun for color cathode ray tube is disclosed which includes: a triode section for forming the thermionic electrons from the cathode into electron beams; a multistep focusing type electrostatic lens means for focusing the electron beams from the triode section. The characteristic feature of the present invention is that: an electrostatic lens is formed through the combination of a UPF type electrostatic lens and a BPF type electrostatic lens; and another UPF type electrostatic lens is formed between the electrodes disposed closely to the triode section among the UPF type or BPF type electrostatic lens forming electrodes, so as for a multiplex multistep focusing type electrostatic lens to be formed. According to the present invention, the spherical aberration acting on the electron beams at the main electrostatic focusing lens can be largely eliminated, and therefore, a high quality picture can be obtained.

3 Claims, 3 Drawing Sheets

ELECTRON GUN FOR COLOR CATHODE RAY TUBE

FIELD OF THE INVENTION

The present invention relates to an electron gun for color cathode ray tube, and particularly to an electron gun in which there is installed an inter-grid electrode electrically insulated from the external electrode, the inter-grid electrode being disposed within a relatively low voltage-receiving electrode among the focus electrostatic lens forming electrodes, in order to form an electrode unit for forming a UPF type electrostatic lens, and the rest of the electrodes for forming a focus electrostatic lens are arranged in the form of a multistep focusing lens, thereby forming a multiplex multistep focusing lens.

BACKGROUND OF THE INVENTION

Generally, an electron gun for color cathode ray tube includes: a cathode for forming the thermonic electrons into an electron beam; a triode section consisting of a first grid electrode and a second grid electrode; and a focusing electrostatic lens section for forming beam spots onto the picture screen after focusing the electron incoming from the triode section.

The electron gun described above is classified into different kinds depending on the constitution of the focusing electrostatic lens.

The electron gun for color cathode ray tube having the simplest structure is represented by a BPF (bi-potential focus) type and a UPF (uni-potential focus) type. The BPF type electron gun for color cathode ray tube includes: a triode section consisting of a cathode, a first grid electrode and a second grid electrode; and a main electrostatic focusing lens means consisting of a first accelerating and focusing electrode and a second accelerating and focusing electrode.

The UPF type electron gun for color cathode ray tube includes: a triode section constituted as mentioned above; and a main electrostatic focusing lens means consisting of a first accelerating and focusing electrode, an intermediate focusing electrode and a second accelerating and focusing electrode.

Of the electrodes of the main electrostatic focusing lens section forming a part of the BPF type electron gun for color cathode ray tube, an ultor voltage in the range of 20–30 KV is supplied to the second accelerating and focusing electrode, and a focusing voltage equivalent to 20–30% of the above mentioned ultor voltage is supplied to the first accelerating and focusing electrode.

Of the electrodes of the main electrostatic focusing lens section forming a part of the UPF type electron gun for color cathode ray tube, both the first accelerating and focusing electrode and the second accelerating and focusing electrode commonly receive the ultor voltage, and the intermediate focusing electrode receive almost a ground voltage.

These BPF and UPF type electron guns for color cathode ray tube are advantageous in that their structures are simple, thereby making it possible to attain a high assembling precesion. However, the electron beams emitted from the triode section enter into the main electrostatic focusing lens through a straight path without changing their directions, and therefore, the electron beams occupy widely to the peripheral areas of the main electrostatic focusing lens. Consequently, the difference between the focusing force around the axis of the main electrostatic focusing lens and the focusing force over the peripheral areas of the main electrostatic focusing lens, i.e., the spherical aberration of the main electrostatic focusing lens is increased, thereby making it impossible to obtain small high density electron beam spots on the pictures screen of the color cathode ray tube.

A multistep focusing type electron gun for color cathode ray tube is developed in order to overcome the above described problem. This multistep focusing type electron gun is constituted such that: an upstream auxiliary lens is disposed between the triode section and the main electrostatic focusing lens means in order to slightly change the path of the electron beams released from the triode section; and then the electron beams are let to advance along straight paths toward the main electrostatic focusing lens, thereby reducing the spherical aberration of the main electrostatic focusing lens.

The multistep focusing type electron gun for color cathode ray tube includes BUF type electron gun and a UBF type electron gun, and these electron guns also employ a BPF or UPF type electrostatic lens as the auxiliary focusing lens, while a BPF or UPF type main electrostatic focusing lens is also adopted.

Such multistep focusing type electron gun for color cathode ray tube is structured in such a manner that the characteristics of the beam spots should be improved.

Rather than the above mentioned BUF or UBF type plain multistep type electron gun, the electron gun may include the upstream auxiliary focusing lens in a multistepped form, thereby forming a multiplex multistep type focusing type electrostatic lens in a color cathode ray tube. If such a multiplex multistep focusing type electron gun is employed in a color cathode ray tube, it will not only improve the characteristics of the beam spots, but also will make it possible to obtain acceptable beams spots even on the peripheral areas of the screen.

However, if the above described multiplex multistep focusing type electron gun is to be formed, a large number of electrodes are required, and the stacked length of the electrodes, i.e., the length of the electron gun is extended, with the result that the efficiency of the assembling of the electron gun is aggravated, and that the assembling precision is deteriorated.

The assembling precision of the electron gun mentioned above mainly refers to the concentricity of the assembled electrodes, and if the electrodes of the electron gun are arranged asymmetrically around the axis of the assembled electrodes, then the electrostatic lens is asymmetrically formed around the axis. Further, the incoming electron beams will form deformed beam spots due to the astigmatism, thereby aggravating the resolving power of color cathode ray tube.

SUMMARY OF THE INVENTION

The present invention is intended to overcome the above described disadvantages of the conventional devices.

Therefore, it is the object of the present invention to provide an effective multiplex multistep focusing type electron gun for color cathode ray tube, in which acceptable beam spots are obtained without generating other adverse effects.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1A:
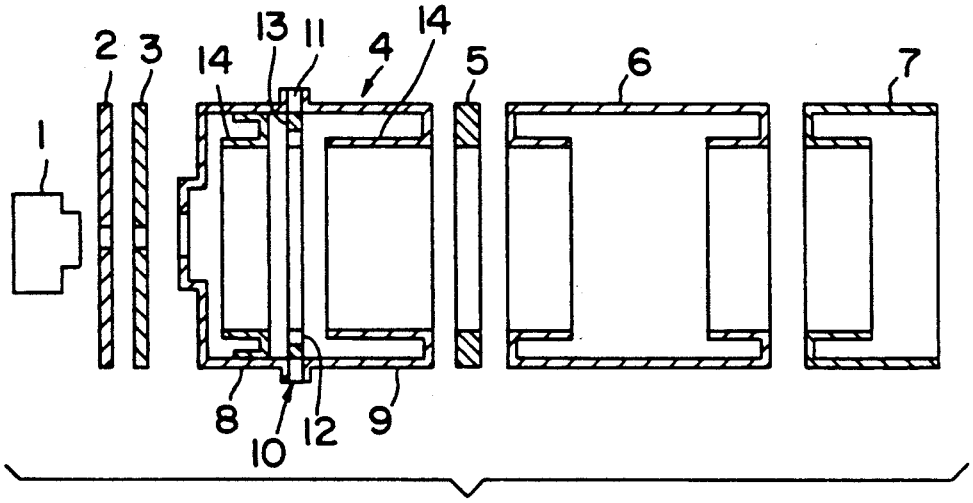
FIGS. 1A and 1B are sectional views of the electron gun for color cathode ray tube according to the present invention.
Figure 1B:
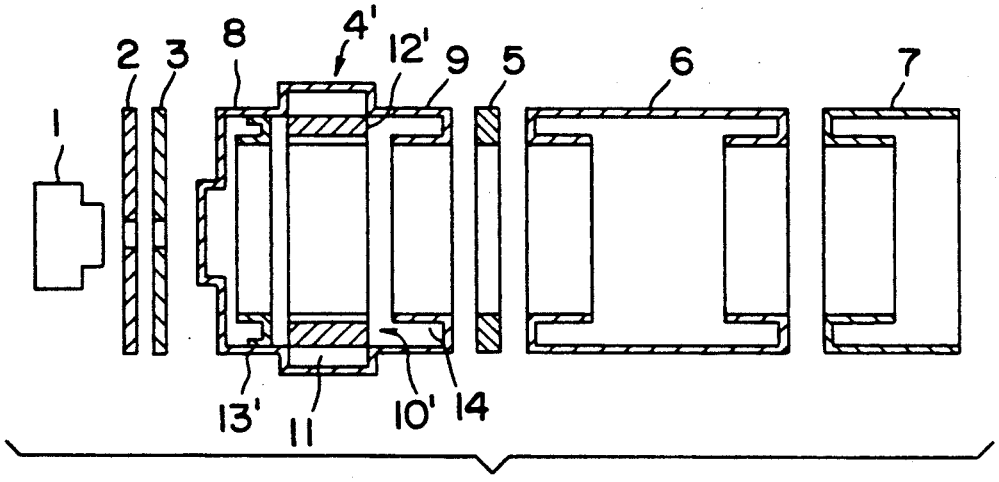

FIGS. 1A and 1B are sectional views showing the critical part of the electron gun for color cathode ray tube according to the present invention. In these drawings, a cathode 1, a first grid electrode 2, a second grid electrode 3, a third grid electrode assembly 4, 4', a fourth grid electrode 5, a first accelerating and focusing electrode 6, and a second accelerating and focusing electrode 7 are stacked in the cited order. Of the above electrodes, the third grid electrode assembly 4 or 4' is constituted such that a lower electrode 8 and a upper electrode 9 are connected to a metallic connecting portion 11 of an inter grid 10 or 10' by welding them, and in this state, and a voltage of the same level is supplied to them in common.

The inter grid 12 or 12' is connected through an insulating member 13 or 13' to the metallic connecting portion 11, and the inter grid 12 having a plurality of beam passing holes 15 receives a voltage which is independent from the common voltage which is supplied to the lower electrode 8, the metallic connecting portion 11 and the upper electrode 9.

Further, inner lips 14 are provided on the inner opposite sides of the lower electrode 8 and the upper electrode 9, in a state opposingly facing to the opposite side portions of the inter grid 12 or 12', and keeping a certain distance from the opposite side portions of the inter grid.

FIGS. 2 and 3 are respectively a plan view and a prospective view of the intergrid electrode unit 10 or 10' employed in the electron gun of the color cathode ray tube according to the present invention, which is shown in FIGS. 1A and 1B.

Figure 2A:
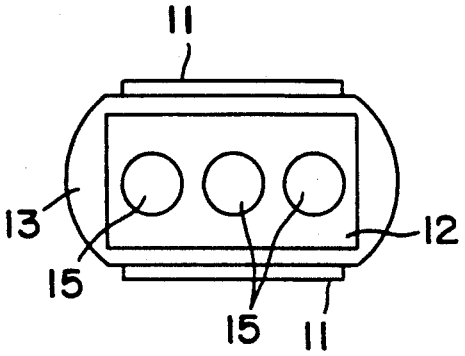
FIGS. 2A and 2B are plan views of the intergrid electrode of the electron gun according to the present invention.
Figure 2B:
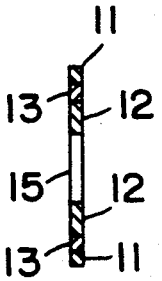
Figure 3A:
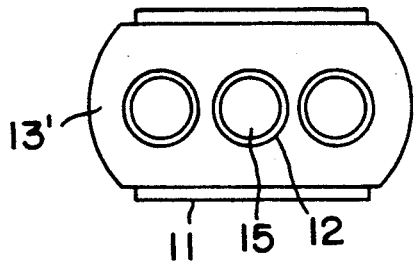
FIGS. 3A and 3B are respectively a plan view and a longitudinal sectional view showing another embodiment of the inter grid electrode of the electron gun according to the present invention.
Figure 3B:
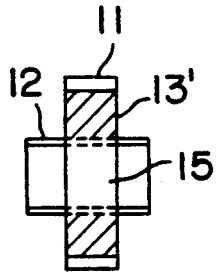
Figure 3C:
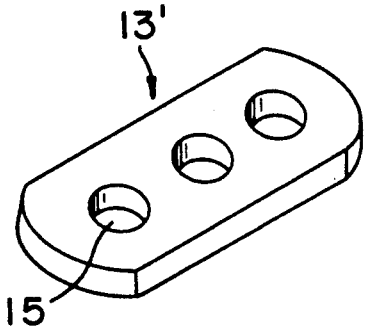
FIG. 3C is a perspective view of a rectangular insulating member.
Figure 3D:
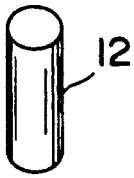
FIG. 3D is a perspective view of a metallic cylindrical lip.
Figure 3E:
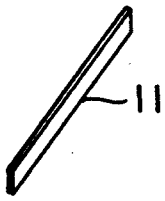
FIG. 3E is a perspective view of a metallic connecting portion taking the shape of a metal rod.

The inter grid electrode unit 10 which is illustrated in FIGS. 1A, 2A and 2B is constituted such that, between a plate shaped inter grid 12 having a plurality of beam passing holes 15 and a metal rod shaped metallic connecting portion 11, there is installed an insulating member 13 in the form of a ring, thereby forming a single unitized component by applying the so-called "brazing method".

Meanwhile, the inter grid electrode unit 10' according to the embodiment of FIGS. 1B, and 3A to 3E is constituted such that a metallic connecting portion 11 is attached to each of the longitudinal edges of a rectangular insulating member 13' on which a plurality of beam passing holes 15 are formed; and a metallic cylindrical lip 12' is inserted into each of the beam passing holes 15 of the rectangular insulating member 13', thereby forming a unitized component by applying the so-called "brazing method".

The electron gun of the present invention constituted as above will now be described as to its operations. The constitution of the electrostatic focusing lens means of the electron gun of color cathode ray tube having the structure as shown in FIGS. 1A and 1B is as shown in FIGS. 4 and 5.

The multiplex multistep focusing type electron gun according to the present invention will be described as to its operations referring to the attached drawings.

Figure 4:
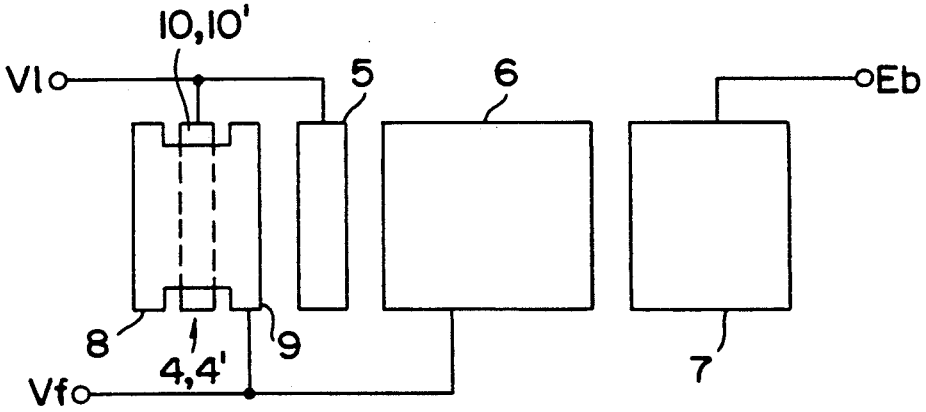
FIG. 4 illustrates the constitution of the electrostatic focusing lens means of the electron gun according to the present invention.
Figure 5:
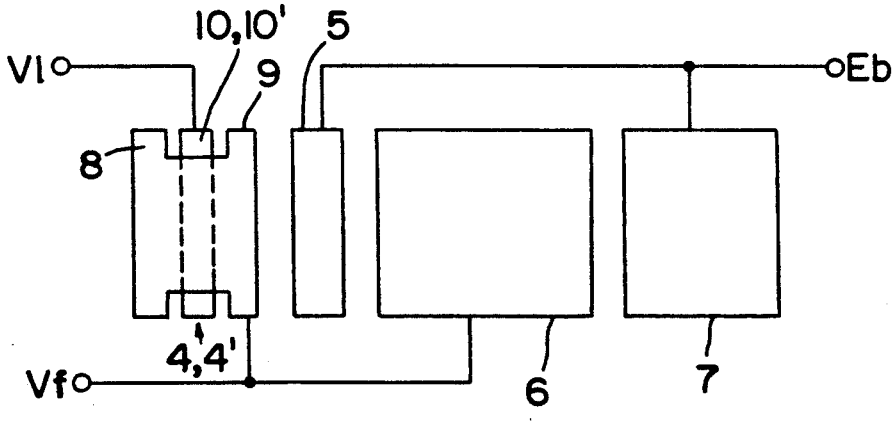
FIG. 5 illustrates the constitution of the electrodes of the electrostatic focusing lens means according to the present invention.

FIG. 4 illustrates an embodiment of the multiplex multistep focusing type electron gun of color cathode ray tube according to the present invention. In this drawing, the first accelerating and focusing electrode 6 and the lower and upper electrodes 8,9 as the external electrodes of the third grid electrode assembly 4 or 4' receive a common voltage Vf which is the focusing voltage. The fourth grid electrode 5 and the inter grid 10 or 10' as the internal electrode of the third grid electrode assembly 4 or 4' receive a separate low voltage V1 which is same as the voltage of the second grid electrode, while the second accelerating and focusing electrode 7 receives an ultor voltage Eb.

The electrostatic focusing lens means shown in FIG. 4 forms a UPF type electrostatic lens within the third grid electrode assembly 4 or 4' which includes the inter grid electrode unit 10 or 10', and also forms a UPF type electrostatic focusing lens between the third grid electrode assembly 4 or 4' and the fourth grid electrode 5, and between the fourth grid electrode 5 and the first accelerating and focusing electrode 6, as well as forming a BPF type electrostatic lens between the first accelerating and focusing electrode 6 and the second accelerating and focusing lens 7.

The UPF type electrostatic lens formed within the third grid electrode assembly 4 or 4' serves as a first upstream auxiliary focusing lens, the intermediate UPF electrostatic lens serves as a second upstream auxiliary focusing lens, and the BPF type electrostatic lens formed between the first accelerating and focusing lens.

FIG. 5 illustrates another embodiment of the multiplex multistep focusing type electron gun for color cathode ray tube according to the present invention. In this drawing, a common voltage Vf is supplied to the first accelerating and focusing electrode 6, the lower electrode 8 and the upper electrode 9, the latter two being the external electrodes of the third grid electrode assembly 4 or 4'.

An ultor voltage Eb is supplied to both the fourth grid electrode 5 and the second accelerating and focusing electrode 7, while a low voltage V1 which is the voltage of the second grid electrode or its equivalent is supplied to the inter grid 10 or 10' which is the internal electrode of the third grid electrode assembly 4 or 4'.

Accordingly, a UPF type electrostatic lens serving as a first upstream auxiliary focusing lens is formed within the third grid electrode assembly 4 or 4' which includes the inter grid electrode 10 or 10', a BPF type electrostatic lens serving as a second upstream auxiliary focusing lens is formed between the third grid electrode assembly 4 or 4' and the fourth grid electrode 5; and a UPF type electrostatic lens serving as a main electrostatic focusing lens is formed between the fourth grid electrode 5 and the first accelerating and focusing electrode 6, and between the first accelerating and focusing electrode 6 and the second accelerating and focusing electrode 7, these being the lenses formed in the electrostatic focusing lens means having the structure as shown in FIG. 5.

According to the multiplex multistep focusing type electron gun for color cathode ray tube of the present invention, the electron beams emitted from the triode section (cathode-the first grid electrode-the second grid electrode) are reduced in their diverging angles through the function of the first upstream auxiliary focusing lens, and therefore, there is a sufficient room for improving the characteristics of the beam currents.

Further, after the reduction of the diverging angles of the electron beams through the function of the first upstream auxiliary focusing lens, the diverging angles of the electron beams incoming to the main electrostatic focusing lens can further be reduced to the optimum state through the function of the second upstream auxiliary focusing lens under any condition, if a proper designing is carried out. Consequently, the spherical aberration acting on the electron beams at the main electrostatic focusing lens can be largely eliminated, and therefore, a high quality picture can be obtained not only on the middle portion of the picture, but also along the peripheral areas of the picture.

Further, as described above, according to the multiplex multistep focusing type electron gun of the present invention, an inter grid 10 or 10' is installed within the third grid electrode assembly 4 or 4', thereby forming a single unitized structure to establish a UPF type electrostatic lens with the single unitized component. Therefore, the number of the parts required for the assembly is same as that of the ordinary multistep focusing type electron gun, i.e., the BUF or UBF type electron gun, and therefore, an assembling precision level same as the ordinary assembling precision level of the ordinary multistep focusing type electron gun can be obtained.

What is claimed is:

1. An electron gun for color cathode ray tube comprising: a triode section having first and second grid electrodes for forming thermionic electrons from the cathode into electron beams in a successive manner, a multi-step focusing type electrostatic lens means for focusing the electron beams from said triode section, characterized in that an electrostatic lens is formed through the combination of a UPF (uni-potential focus) type electrostatic lens and a BPF (bi-potential focus) type electrostatic lens; and another UPF electrostatic lens is formed by a third grid electrode assembly comprising a lower grid electrode in close proximity to the triode, an upper grid electrode substantially adjacent the lower grid electrode, a metallic connecting portion welded intermediate the upper and lower grid electrodes, an insulating member mounted to the metallic connecting portion and an inter grid electrode mounted to the insulating member within the third grid electrode assembly and electrically independent from the upper and lower electrodes, portions of said lower electrode in proximity to the inter grid electrode being free of recesses on portions thereof in proximity to the upper grid electrode and the inter grid electrode for reducing diverging angles of electron beams emitted from the triode section, and whereby the disposition of the inter grid electrode within the third grid electrode assembly achieves a simple efficient structure.

2. The electron gun for color cathode ray tube as claimed in claim 1, further comprising a first accelerating and focusing electrode spaced from the upper electrode; means for supplying a focusing voltage Vf as a common voltage to said upper and lower electrodes of said third grid electrode assembly and to said first accelerating and focusing electrode; a fourth grid electrode intermediate said third grid electrode assembly and said first accelerating and focusing electrode; means for supplying a low voltage V1 as a common voltage to said fourth grid electrode and to said inter grid electrode which is internal of said third grid electrode assembly; a second accelerating and focusing electrode downstream of and adjacent said accelerating and focusing electrode; means for supplying an ultor voltage Eb to said second accelerating and focusing electrode; whereby a UPF type electrostatic lens is formed between said third grid electrode assembly and said fourth grid electrode, and between said fourth grid electrode and said first accelerating and focusing electrode; a BPF type electrostatic lens is formed between said first accelerating and focusing electrode and said second accelerating and focusing electrode; and a UPF type electrostatic focusing lens is formed within said third grid electrode assembly including said inter grid electrode.

3. The electron gun for color cathode ray tube as claimed in claim 1, further comprising a first accelerating and focusing electrode spaced from the upper electrode; means for supplying a focusing voltage as a common voltage to said first accelerating and focusing electrode and to said upper and lower electrodes of said third grid electrode assembly; a fourth grid electrode intermediate said third grid electrode assembly and said first accelerating and focusing electrode; a second accelerating and focusing electrode downstream of said first accelerating and focusing electrode; means for supplying an ultor voltage as a common voltage to said fourth grid electrode and said second accelerating and focusing electrode; means for supplying a low voltage V1 to said inter grid electrode which is internal of said third grid electrode assembly; whereby a BPF type electrostatic focusing lens is formed between said third grid electrode assembly and said fourth grid electrode; a UPF type electrostatic focusing lens is formed between said fourth grid electrode and said first accelerating and focusing electrode, and between said first accelerating and focusing electrode and said second accelerating and focusing electrode; and a UPF type electrostatic focusing lens is formed within said third grid electrode assembly including said inter grid electrode unit.

* * * * *